United States Patent [19]

Seymour et al.

[11] Patent Number: 5,004,878

[45] Date of Patent: Apr. 2, 1991

[54] MOLDED CASE CIRCUIT BREAKER MOVABLE CONTACT ARM ARRANGEMENT

[75] Inventors: Raymond K. Seymour, Plainville; Marshall B. Hart, Middletown; Gary D. Magnon, Bristol; Michael C. von Kannewurff, West Willington; Dennis J. Doughty, Plainville, all of Conn.

[73] Assignee: General Electric Company, New York, N.Y.

[21] Appl. No.: 330,521

[22] Filed: Mar. 30, 1989

[51] Int. Cl.[5] ..... H01H 33/02

[52] U.S. Cl. ..... 200/144 R; 200/147 R; 335/16

[58] Field of Search ..... 200/144 R, 147 R, 146 R; 335/201, 16

[56] References Cited

U.S. PATENT DOCUMENTS

| | | | |
|---|---|---|---|
| 4,086,460 | 4/1978 | Gillette | 200/146 R |
| 4,245,203 | 1/1981 | Wafer et al. | 335/16 |
| 4,642,431 | 2/1987 | Tedesco et al. | 200/153 G |
| 4,695,690 | 9/1987 | Banfi | 200/147 R |
| 4,731,921 | 3/1988 | Ciarcia et al. | 29/622 |
| 4,733,033 | 3/1988 | Morris et al. | 200/153 G |
| 4,931,603 | 6/1990 | Castonguay et al. | 200/144 R |

*Primary Examiner*—Robert S. Macon

*Attorney, Agent, or Firm*—Richard A. Menelly; Walter C. Bernkopf; Fred Jacob

[57] ABSTRACT

A molded case circuit breaker having a pair of movable contact arms arranged within a single pole utilizes a shunt clip between the movable contact arms to insure electrical continuity between the contact arms and the support base during intense short circuit interruption. A compression spring-driven camming arrangement insures good electrical connection between the circuit breaker contacts under steady quiescent operating conditions while preventing reclosing of the contacts during short circuit interruption.

10 Claims, 4 Drawing Sheets

10

10

MOLDED CASE CIRCUIT BREAKER MOVABLE CONTACT ARM ARRANGEMENTcl

BACKGROUND OF THE INVENTION

Current limiting circuit interruption devices such as molded case circuit breakers, generally contain a movable contact arranged at one end of a movable contact arm which operates to electrodynamically repel the movable contact arm upon the occurrence of a short circuit overcurrent condition to drive the movable contact away from the fixed contact and interrupt the protected circuit. The same movable contact arm cooperates with an operating mechanism to separate the movable contact upon occurrence of overcurrent conditions less than short circuit intensity. In most current limiting circuit breaker designs, a flexible braid conductor is attached to the movable contact arm at one end and to the load terminal strap assembly at an opposite end to insure good electrical continuity between the movable contact arm and the support during intense short circuit interruption.

U.S. Pat. No. 4,733,033, which patent is incorporated herein for reference purposes, describes one such current limiting circuit breaker that utilizes a spring-clip contact arm retainer to insure good electrical continuity between the movable contact arm and the associated support structure during intense short circuit conditions. When the spring-clip contact arm retainer is used within current limiting circuit breakers of higher ampere ratings, local ionization can occur between the movable contact arm and the support structure causing the mating surfaces to become pitted.

U.S. Pat. No. 4,245,203 describes a movable contact arm arrangement wherein the contact arm support posts are bifurcated. The current paths through the bifurcated support posts generate complementary magnetic fields which, in turn, drive the support posts into good electrical connection with the movable contact arm pivot during intense short circuit conditions.

U.S. Pat. No. 4,931,603 entitled "Molded Case Circuit Breaker Movable Contact Arm Arrangement", which patent is incorporated herein for reference purposes, describes a pair of shunt plates arranged on a pair of contact arm support posts on both sides of the movable contact arm to electrically shunt some of the short circuit current over to the support posts during intense short circuit conditions.

When a pair of movable contact arms and corresponding movable contacts are arranged within each pole of a three-pole current limiting circuit breaker, the current divides between the two movable contact arms and thereby increases the possibility of localized arcs between both contact arms when the braided electrical conductor is eliminated. One purpose of the instant invention, accordingly, is to provide inexpensive and efficient means for insuring that localized arcing is prevented when two such movable contact arms are employed.

Another problem encountered within current limiting circuit breakers, is the possibility that one movable contact arm within one pole will become electrodynamically repulsed to an open position before the operating mechanism can respond to move the movable contact arms within the other two poles to the open position resulting in an adverse condition known as "single phasing".

A further problem involved with current limiting circuit breakers when one of the movable contact arms is electrodynamically repulsed before the operating mechanism responds to move the remaining movable contact arms to the open position, is the possibility that the movable contact on the single movable contact arm could bounce back into electrical connection with the associated fixed contact under intense short circuit conditions. This could cause local arcing to occur at the instant of contact to thereby heat and fuse the contacts together. When the operating mechanism later responds to rotate all the movable contact arms to their open positions, the fused contacts could prevent the associated movable contact arm from moving with the operating mechanism.

One means for controlling the travel of an electrodynamically repulsed movable contact arm is found within U.S. Pat. No. 4,695,690 wherein a ratchet and pawl arrangement are benefically employed.

Another attempt to control the operation of an electrodynamically driven movable contact arm is described within U.S. Pat. No. 4,642,431 which utilizes a spring loaded clip contained within a plastic crossbar assembly. A cam surface on the movable contact arm cooperates with the spring-clip to prevent the movable contact arm from rebounding back to a closed position.

A further object of the instant invention accordingly, is to prevent the rebound of the movable contact arm by means of a cam assembly independent of the plastic crossbar.

SUMMARY OF THE INVENTION

The invention comprises a current limiting circuit breaker movable contact arm assembly wherein a single U-shaped load strap forms one part of a hinged joint connection with a pair of independently rotatable movable contact arms. A shunt clip attached to the load strap interfaces with both movable contact arms to provide an electrical shunt path during intense short circuit conditions. A cam assembly arranged independent from the operating mechanism crossbar, applies pressure on the movable contacts to insure good electrical transport between the fixed and movable contacts during quiescent current conditions while holding the movable contact arms in an overcenter position under intense short circuit conditions.

DESCRIPTION OF THE PREFERRED EMBODIMENT

Figure 1:
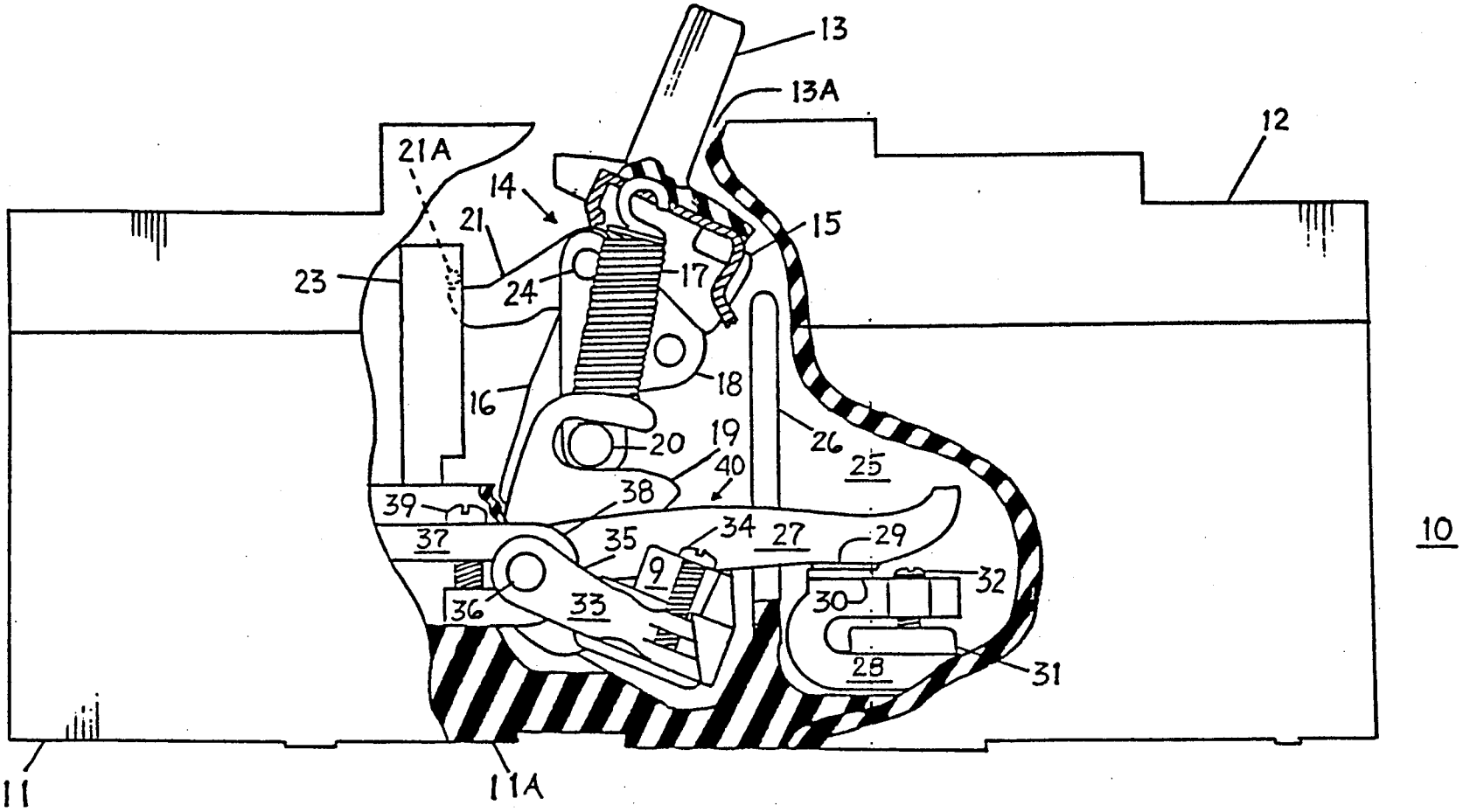
FIG. 1 is a side view, in partial section, of a current limiting circuit breaker employing the movable contact arm assembly according to the invention.

A current limiting circuit breaker 10 of the kind employing a molded plastic case 11 to which a molded plastic cover 12 is attached is depicted in FIG. 1. The circuit breaker includes an operating handle 13 that extends through a slot 13A formed within the cover and which manually overrides the circuit breaker operating mechanism shown generally at 14. The operating handle interfaces with the operating mechanism by means of the handle yoke 15 and a pair of side frames 16, one of which is removed to show one of the powerful operating springs 17 that biases the operating mechanism by means of upper link 18 and an operating cam 19 which captures a roller 20 at the bottom of the upper link. The cradle 21 restrains the operating mechanism against the bias of the operating springs by engagement between the cradle hook 21A and the operating latch assembly 23. A good description of a similar latch assembly is found within U.S. Pat. No. 4,731,921 which patent is incorporated herein for purposes of reference and should be reviewed for the operation of a circuit breaker operating mechanism and latch assembly. The cradle pivotally connects with the upper link 18 by means of the upper link pivot 24 to hold the operating mechanism and the movable contact arm 27, that connects with the operating mechanism by means of the operating cam 19, in a closed condition wherein the movable contact 29 at the end of the movable contact arm abuts the fixed contact 30 arranged on the fixed contact arm 28. The fixed contact arm is fastened to the bottom case extension 31 by means of a screw 32. The U-shaped configuration of the fixed contact arm 28 and the arrangement of the bottom contact 30 promotes the electrodynamic repulsion of the movable contact arm as described within U.S. Pat. No. 4,086,460, which patent is incorporated herein for reference purposes. The movable contact arm is fastened to the base 11A of the circuit breaker case 11 by means of a screw 39. An arc chamber 25 suppresses and extinguishes the arc that occurs when the contacts become separated and an integrally-formed interior baffle 26 prevents the arc byproducts from interfering with the operating mechanism 14. The movable contact arm 27 is part of the movable contact arm assembly 40 which includes the shaped movable contact arm support 37 along with the plunger assembly 33. The movable contact arm is attached to the movable contact arm support by the provision of a pivot pin 36 through the U-shaped end 38 of the movable contact arm support and through the movable contact arm. The pivotal attachment between the movable contact arm and the movable contact arm support allows the movable contact arm to become "blown-open" by means of the electrodynamic repulsion generated between the movable contact arm and the fixed contact arm 28 as described earlier. The arrangement between the cam 19 and the movable contact arm 27 allows the movable contact arm to be moved to the open position upon the automatic release of the cradle hook 21A by the latch assembly 23 as well as by the manual intervention of the operating handle 13. The pivot pin 36 also extends through one end of the plunger assembly arm 35 while the plunger assembly 33 is attached to the circuit breaker crossbar 9 by means of a pair of screws 34, one of which is visible in FIG. 1.

Figure 2:
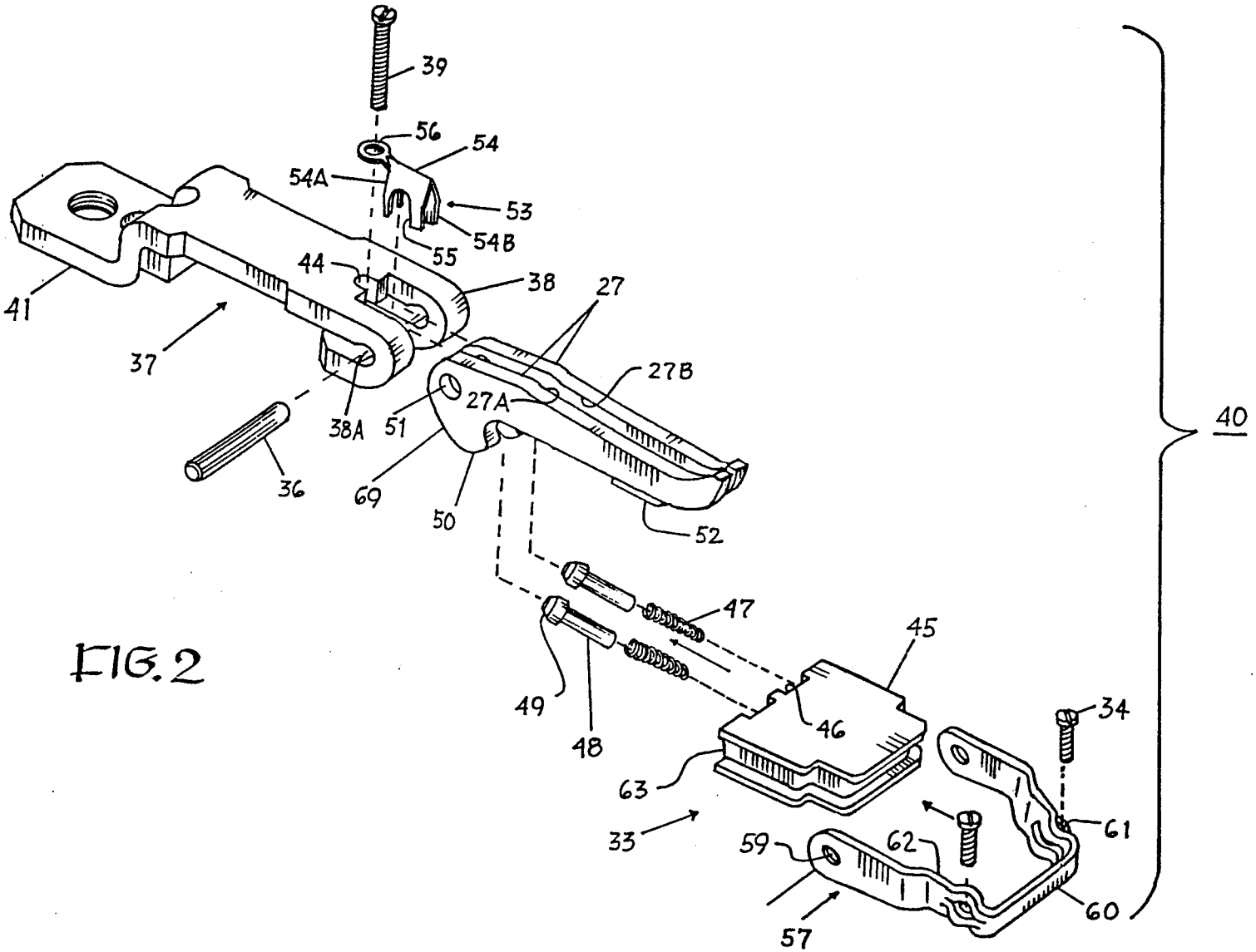
FIG. 2 is a top perspective view in isometric projection of the movable contact arm arrangement depicted in FIG. 1.

The arrangement of the components of the movable contact arm assembly 40 is best seen by referring now to FIG. 2. A pair of movable contact arms 27 are positioned within the slotted U-shaped end 38 of the movable contact arm support 37 opposite from the downwardly offset end 41. The thru-holes 51 formed through the movable contact arm are aligned within the slot 38A defined by the U-shaped end and the pivot pin 36 is then inserted through the slot and thru-holes. A shunt clip 53 which is stamped from a tempered metal conductive plate such as a copper alloy and shaped to form a V-shaped body member 54 through which a slot 55 is formed along with the apertured extension 56 is used to shunt the electric current between the movable contact arms and the movable contact arm support 37. The shunt clip is tempered to provide the resiliency needed to maintain contact with the movable contact arms. With the pivot pin 36 inserted within the movable contact arm support 37, the shunt clip 53 is positioned within the support such that the sides 54A, 54B nest between the contact arms and interface with the interior sides 27A, 27B respectively. A screw 39 passes through the apertured extension 56 and down through the thru-hole 44 to threadingly engage the base 11A of the circuit breaker case 11 (FIG. 1). A plunger assembly 33 is next attached to the contact arm assembly by positioning the pair of thru-holes 59 formed at the end of arms 35 on the U-shaped strap 57 over the ends of the pivot pin 36 on both sides of the support 37. The plunger assembly includes a metallic housing 45 within which a pair of circular recesses 46 are formed and which contain a pair of plungers 48 and contact springs 47. The cam surfaces 49 formed on the end of the plungers interact with the cam follower surface 50 formed on the shoulder 69 of the movable contact arms 27 opposite the movable contacts 52. The U-shaped strap 57 that consists of the upstanding arms 35 and intervening bight 60 further includes a pair of threaded openings 61 adjacent the bight for attaching the plunger assembly to the plastic crossbar 9 (FIG. 1) when the housing 45 is encompassed by the strap 57 and the slots 63 formed on both sides of the housing snappingly engage corresponding offset projections 62 formed on the interior surface of the strap 57.

Figure 3:
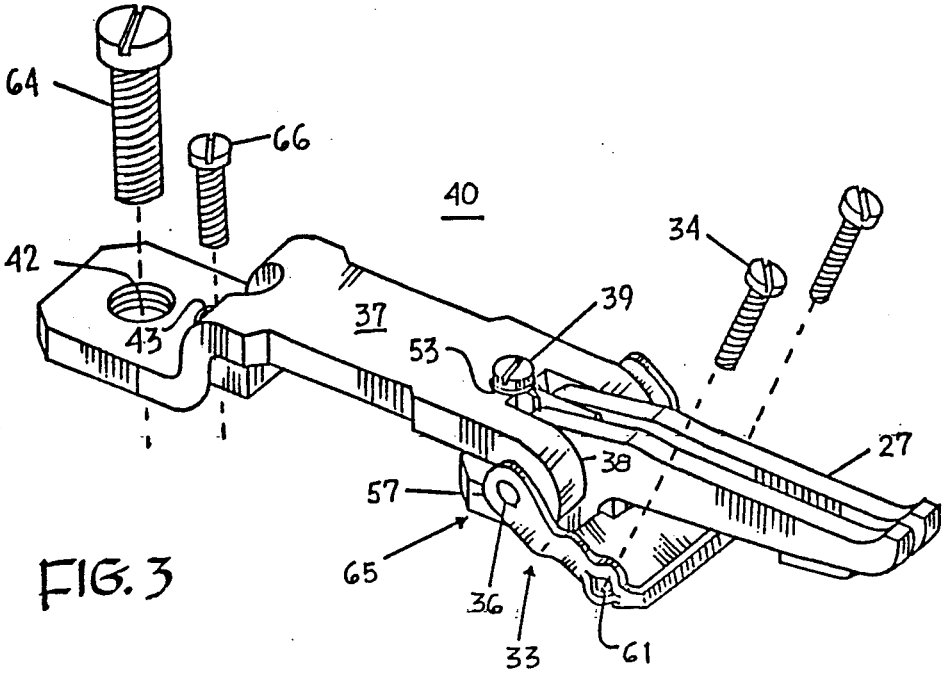
FIG. 3 is a top perspective view of the contact arm assembly depicted in FIGS. 1 and 2.

The movable contact arm assembly 40 is shown in FIG. 3 with the U-shaped strap 57 positioned over the end of the pivot pin 36 and with the shunt clip 53 securely fastened to the support 37 by means of screw 39. The arrangement of the pivot pin 36, movable contact arms 27 and U-shaped end 38 form a hinge-like joint generally depicted at 65 which permits the free rotation of the movable contact arms when plunger assembly 33 is fastened to the plastic crossbar by means of screws 34 and threaded openings 61 formed within the U-shaped strap 57 as described earlier. The support is fastened to the base by means of screw 66 and thru-hole 43. The load terminal screw 64 is then attached to the support by means of the threaded opening 42.

Figure 4:
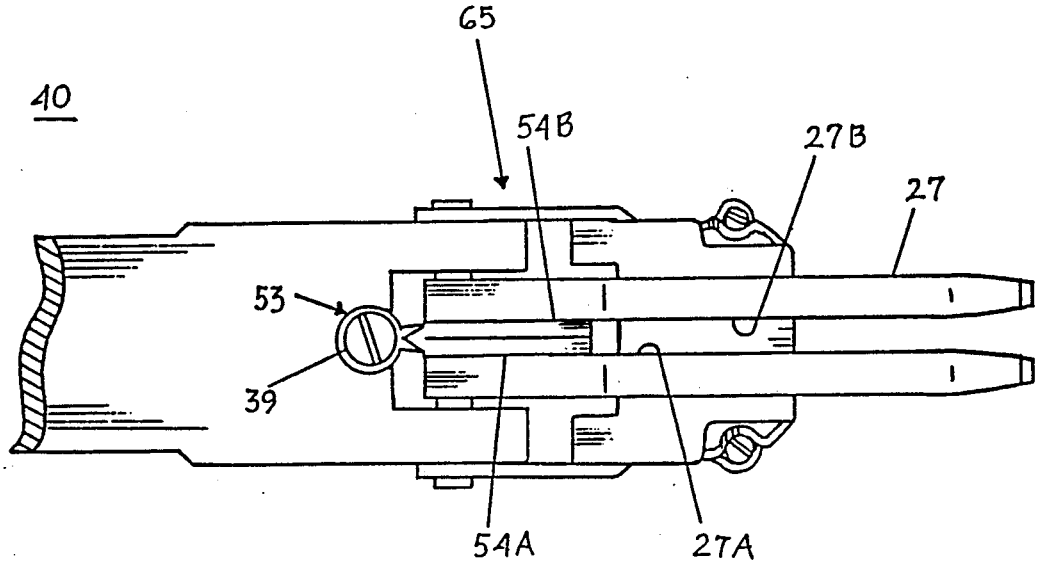
FIG. 4 is a plan view of the movable contact arm assembly of FIG. 3.

The good electrical connection between the movable contact arms 27 and the shunt clip 53 is best seen by referring now to FIG. 4 wherein the hinge-like joint 65 is defined within the movable contact arm assembly 40. The sides 54A, 54B of the shunt clip 53 are pressed tightly against the inner surfaces 27A, 27B of the movable contact arms 27. The spring-clip remains fixedly in place by means of the screw 39 while the movable contact arms move between their open and closed position and remain in sliding contact with the spring-clip due to the tension exerted against inner surfaces 27A, 27B of the movable contact arms 27 by means of the sides 54A, 54B of the shunt clip 53.

Figure 5A:
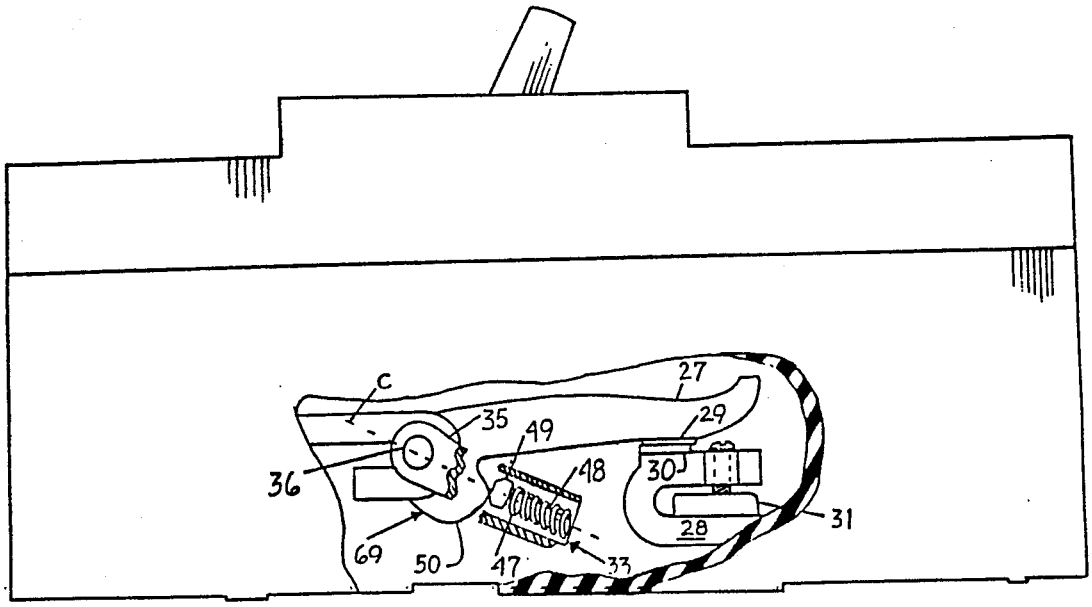
FIGS. 5A and 5B are side views in partial section depicting the movable contact arm assembly of the preceding figures in the "closed" and "blown-open" conditions respectively.
Figure 5B:
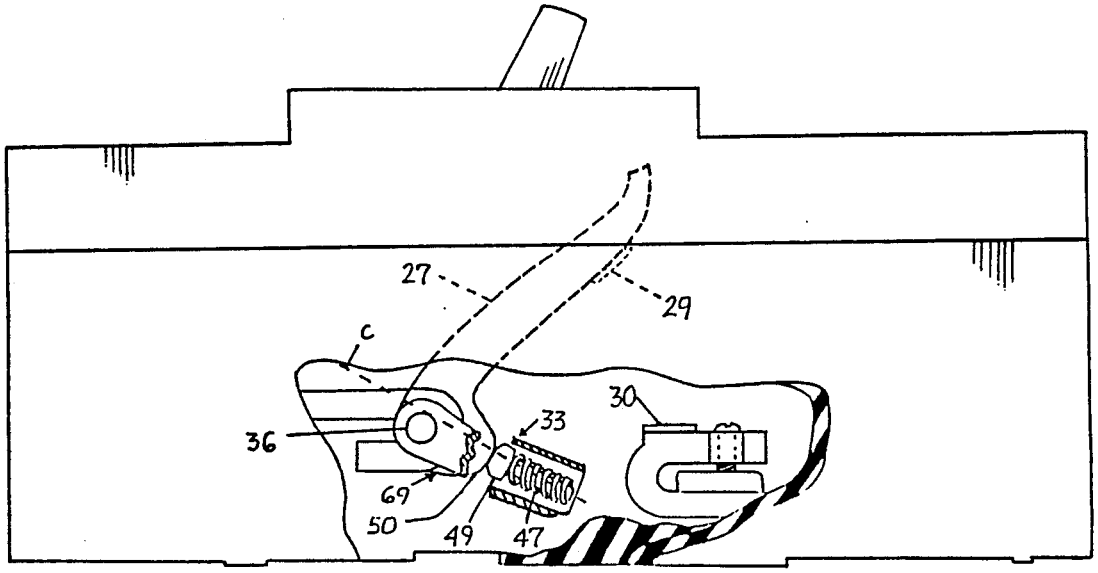

The operation of the plunger assembly 33 is best seen by referring now to FIGS. 5A and 5B wherein one of the movable contact arms 27 within the circuit breaker 10 is depicted in a "closed" condition and a "blown-open" condition respectively. In FIG. 5A, the movable contact arm 27 is depicted in its closed position with the movable contact 29 held tightly against the fixed contact 30 under the urgence of the contact spring 47 which operates on the movable contact arm by contact between the cam surface 49 at the end of plunger 48 and the cam follower surface 50 formed on the shoulder 69 of the movable contact arm 27. Part of the plunger assembly arm 35 and the remaining surface of the plunger assembly 33 is removed to show the location of the cam surface 49 when the line of action C of the spring force acting on the movable contact arm is below the center line of the pivot pin 36 about which the movable contact arm rotates. When a short circuit condition occurs, driving the movable contact arm 27 to its "blown-open" condition as shown in FIG. 5B, the movable contact 29 is rapidly separated from the fixed contact 30 to interrupt the circuit current. At the same time, the cam surface 49 rides along the cam follower surface 50 such that the line of action C of the spring force is over the center of the pivot pin 36, such that the movable contact arm remains locked in the "blown-open" position to thereby allow the operating mechanism 14 (FIG. 1) to move the remaining movable contact arms (not shown) to their respective open positions. The provision of metal components within the plunger assembly 33 attached to the top of the plastic crossbar 9 in FIG. 1 advantageously provides simplified assembly in a high speed circuit breaker manufacturing process as well eliminating interface wear which otherwise could occur between metal and plastic components.

Having thus described our invention, what we claim as new and desire to secure by Letters Patent is:

1. A current limiting circuit interrupter comprising:

a molded plastic case and cover;

a movable contact arm support within said case having load terminal screw receiving means formed at one end and movable contact arm attachment means formed at an opposite end thereof;

a movable contact arm supported within said movable contact arm attachment means and arranged for driving a movable contact out of electric connection with a fixed contact upon occurrence of an intense overcurrent condition through said contacts; and a shunt clip attached to said movable contact arm support and abutting said movable contact arm to thereby maintain electric connection between said movable contact arm support and said movable contact arm when said movable contact is driven out of electric connection with said fixed contact.

2. The current limiting circuit interrupter of claim 1 including a contact spring support attached to said case and containing a spring-biased plunger having cam means formed at one end interacting with cam follower means formed on a shoulder of said movable contact arm to hold said movable contact in good electrical connection with said fixed contact upon quiescent circuit current conditions through said fixed and movable contacts and holding said movable contact arm in an open overcenter condition upon short circuit conditions through said contacts.

3. The current limiting circuit interrupter of claim 1 wherein said movable contact arm attachment means comprises a U-shaped configuration and said load terminal screw receiving means comprising an apertured surface off-set below said U-shaped configuration.

4. The current limiting circuit interrupter of claim 2 wherein said shoulder includes an aperture, said aperture being aligned within said U-shaped end.

5. The current limiting circuit interrupter of claim 4 wherein said shunt clip includes a V-shaped body member having a shunt clip aperture and wherein said shunt clip aperture is aligned with said shoulder aperture within said U-shaped configuration.

6. The current limiting circuit interrupter of claim 5 including a pivot pin arranged through said U-shaped end, said shoulder aperture and said shunt clip aperture.

7. The current limiting circuit interrupter of claim 2 wherein said contact spring support includes an apertured body member and a U-shaped strap, said U-shaped strap including a pair of arms extending from a bight, said arms each including a thru-hole formed at their ends.

8. The current limiting circuit interrupter of claim 7 wherein said thru-hole is arranged around a corresponding end of said pivot pin.

9. The current limiting circuit interrupter of claim 8 including an opening through each of said arms for receiving fasteners to hold said strap to said case.

10. The current limiting circuit interrupter of claim 9 wherein said shunt clip further includes an apertured extension on a top part of said V-shaped body member for receiving a fastening screw to attach said shunt clip to said movable contact support.

* * * * *